US005915465A

United States Patent [19]

Fix et al.

[11] Patent Number: 5,915,465

[45] Date of Patent: Jun. 29, 1999

[54] HEAT EXCHANGER

[75] Inventors: Michael Fix; Matthias Blach; Konrad Nassauer, all of Berlin, Germany

[73] Assignee: Deutsche Babcock-Borsig Aktiengesellschaft, Berlin, Germany

[21] Appl. No.: 09/042,136

[22] Filed: Mar. 13, 1998

[30] Foreign Application Priority Data

Mar. 14, 1997 [EP] European Pat. Off. ..... 97104377

[51] Int. Cl.[6] ..... F28D 7/06; F28F 27/02

[52] U.S. Cl. ..... 165/103; 165/159; 165/161; 165/DIG. 113; 165/DIG. 118; 165/DIG. 409

[58] Field of Search ..... 165/159–161, 165/102, 103

[56] References Cited

U.S. PATENT DOCUMENTS 2,146,953 2/1939 Hans ..... 165/103
3,760,870 9/1973 Guetlhuber ..... 165/35

FOREIGN PATENT DOCUMENTS 31 47 512 of 0000 Germany .
2 134 240 of 0000 United Kingdom .

*Primary Examiner*—Allen Flanigan
*Attorney, Agent, or Firm*—Herbert Dubno

[57] ABSTRACT

A heat exchanger has an outer pressure jacket, which is provided with an entry connection for the supply of and an exit connection for the removal of a first heat exchange medium, the jacket surrounding U-shaped, bent pipes through which a second heat exchange medium flows. The pipes are mounted in a pipe supporting floor that is connected with the pressure jacket. The U-shaped pipes are surrounded by a guide jacket which is inwardly radially spaced from the inside wall of the pressure jacket and defines an intermediate annular space therewith. Inner and outer legs of the U-shaped pipes are respectively positioned on one of two concentrical partial circles. The inner pipe legs surround a central pipe which is oriented along the longitudinal axis of the heat exchanger, is connected with the entry connection, is open towards the interior of the heat exchanger, and extends from one end of the heat exchanger to the vicinity of the pipe supporting floor which is located at the other end of the heat exchanger. A separator jacket is positioned between the inner and outer legs of the U-shaped pipes and is connected to the pipe supporting floor. The guide jacket is sealingly connected at one end with the central pipe and at its open end extends close to the pipe supporting floor. The exit connection which originates from the annular space between the guide jacket and the pressure jacket is positioned at the end of the heat exchanger which is remote from the open end of the guide jacket. The central pipe is provided at an inflow end with a valve chamber including a valve arrangement for controlling the flow of the heat exchange medium through the central pipe for adjustment of the temperature of the heat exchange medium flowing in the jacket.

4 Claims, 3 Drawing Sheets

HEAT EXCHANGER

FIELD OF THE INVENTION

The present invention relates to heat exchangers for the transfer of heat energy between first and second fluid heat transfer media. More particularly this invention relates to heat exchangers having an outer pressure jacket, U-shaped heat exchange medium carrying pipes, and an intermediate guide jacket.

BACKGROUND OF THE INVENTION

A heat exchanger with an outer pressure jacket, U-shaped pipes, and an intermediate guide jacket is known from DE-PS 20 33 128. In this known heat exchanger the guide jacket is open at both ends and is provided in the middle with a feed connection for the first medium flowing through the jacket. The first medium, which is the medium to be cooled, is distributed within the guide jacket to both sides to flow partly parallel to the second fluid medium in the heat exchange pipes and partly in counterflow thereto. Thereafter, the first medium in the jacket enters into the annular space between the guide jacket and the outer pressure jacket from which it is subsequently drained. In this manner, the pressure jacket does not come into contact with medium of high entry temperature.

In some applications, it is desired to control the temperature of the medium to be cooled and flowing inside the jacket. To achieve this goal, a bypass arrangement is known (DE-PS 28 46 455) which consists of a central pipe that is positioned parallel to the longitudinal axis of the heat exchanger. This central pipe directly connects a hot gas entry chamber with a cooled hot gas exit chamber and at one end houses a closing or regulating member. This bypass arrangement is only usable in straight pipe heat exchangers wherein the heat exchange pipes are held in two pipe supporting floors which respectively delimit the gas entry chamber and the gas exit chamber.

OBJECTS OF THE INVENTION

It is an object of the invention to provide a heat exchanger with U-shaped pipes, wherein the final temperature of the medium in the jacket can be controlled and the pressure jacket is protected from an excessive temperature load.

Another object of the invention is to provide an improved heat exchanger which obviates drawbacks of earlier systems.

SUMMARY OF THE INVENTION

Accordingly, the invention provides a heat exchanger for transferring heat between first and second heat exchange media, including an outer pressure jacket which is provided with an entry connection for the supply of the first heat exchange medium and an exit connection for the removal of the first heat exchange medium. U-shaped pipes are positioned within the pressure jacket which are affixed in a pipe supporting floor that is connected with the pressure jacket. A guide jacket surrounds the U-shaped pipes and is radially spaced apart from the inside wall of the pressure jacket and defines an intermediate annular space therewith. Inner and outer legs of the U-shaped pipes are respectively positioned on one of two concentric partial circles, the inner pipe legs surrounding a central pipe which is oriented along the longitudinal axis of the heat exchanger. The central pipe is connected with the entry connection, is open towards the interior of the heat exchanger, and extends from one end of the heat exchanger close to the pipe supporting floor which is located at the other end of the heat exchanger, a separating jacket being positioned between the inner and outer legs of the U-shaped pipes and being connected to the pipe supporting floor. The guide jacket is sealingly connected at one end with the central pipe and with its open end extends close to the pipe supporting floor. The exit connection which originates from the annular space between the guide jacket and the pressure jacket is positioned at that end of the heat exchanger which is remote from the open end of the guide jacket.

The positioning of the U-shaped pipes and the multiple redirecting of the heat exchange medium flowing in the jacket within the heat exchanger by way of the guide and separating jackets makes it possible to provide the central pipe with a shut-off and control member and to thereby provide a heat exchanger with U-shaped pipes having a bypass arrangement. At the same time, the medium in the jacket is guided such that it only contacts the pressure jacket after it has been cooled to some degree.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
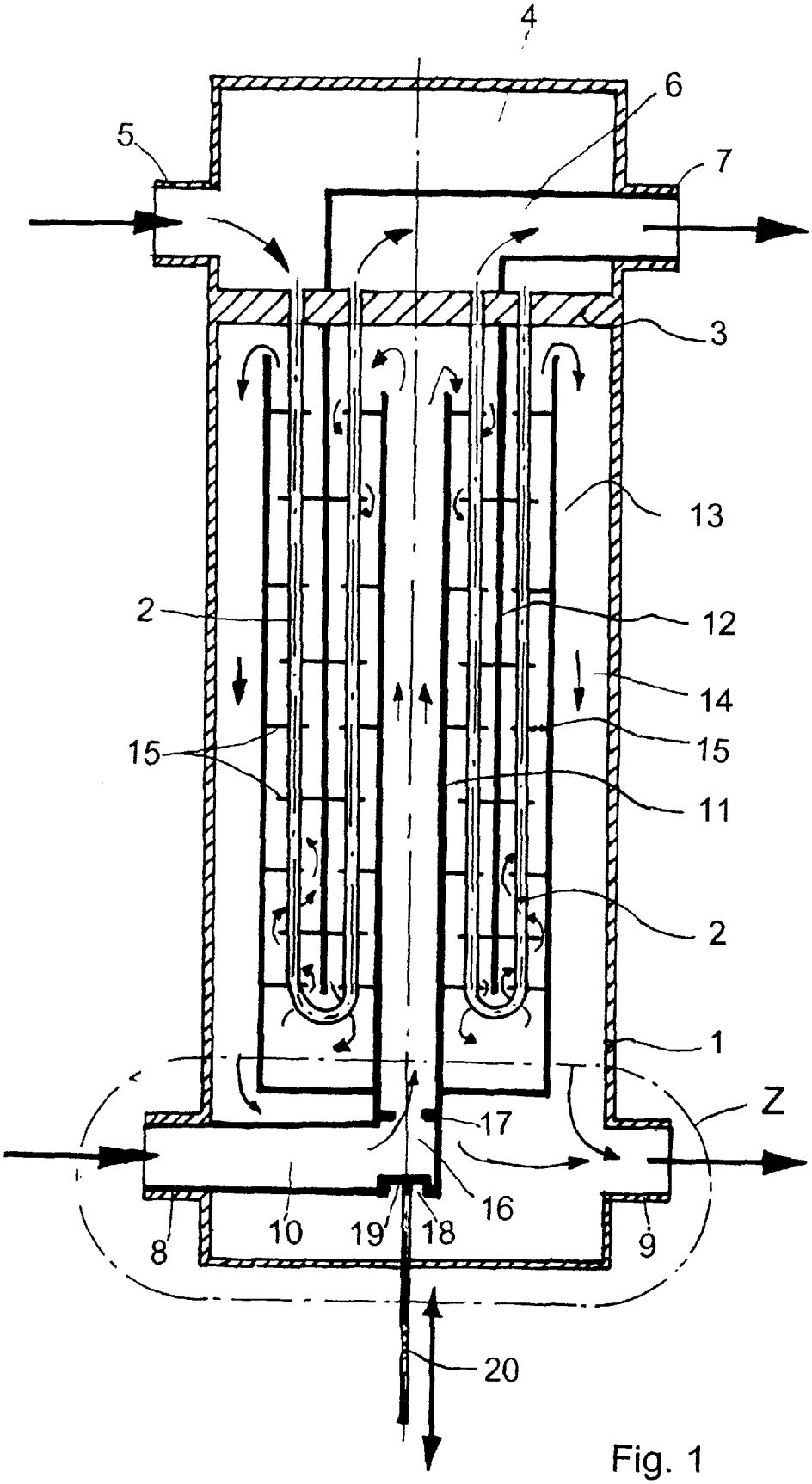
FIG. 1 is a longitudinal section through a preferred heat exchanger in accordance with the invention.

The preferred heat exchangers illustrated in the drawing are preferably used for the cooling of hot gases from an ammonia or methanol producing plant or from a coal degassing plant whereby steam is used as the cooling medium and is superheated for cooling of the hot gases.

In the preferred embodiment shown in FIG. 1, the heat exchanger includes a pressure jacket 1 which encloses a bundle of U-shaped, bent pipes 2. The pipes 2 are fitted into a pipe supporting floor or tube sheet 3, which is connected with the pressure jacket 1. On the side of the pipe supporting floor 3 which is remote from the pipes 2 there is provided an entry chamber 4 with an entry connection 5 for the supply of a first heat exchanger medium, for example, steam. An exit chamber 6 is located within the entry chamber 4, is connected with the pipe supporting floor 3 and is sealed from the entry chamber 4. The exit chamber 6 is provided with an outlet connection 7 which protrudes from the entry chamber 4.

The U-shaped pipes 2 are oriented such that the inflow ends thereof are located on a partial circle and the outflow ends thereof are located on another partial circle. The inflow ends of the pipes 2 open into the entry chamber 4 and the outflow ends open into the exit chamber 6. This results in a flow direction of the first heat exchange medium in the pipes as indicated by the arrows. As illustrated in FIG. 1, the exit chamber 6 is preferably of circular cross section and centrally positioned, which means that it is concentric with a longitudinal axis of the heat exchanger.

Figure 2:
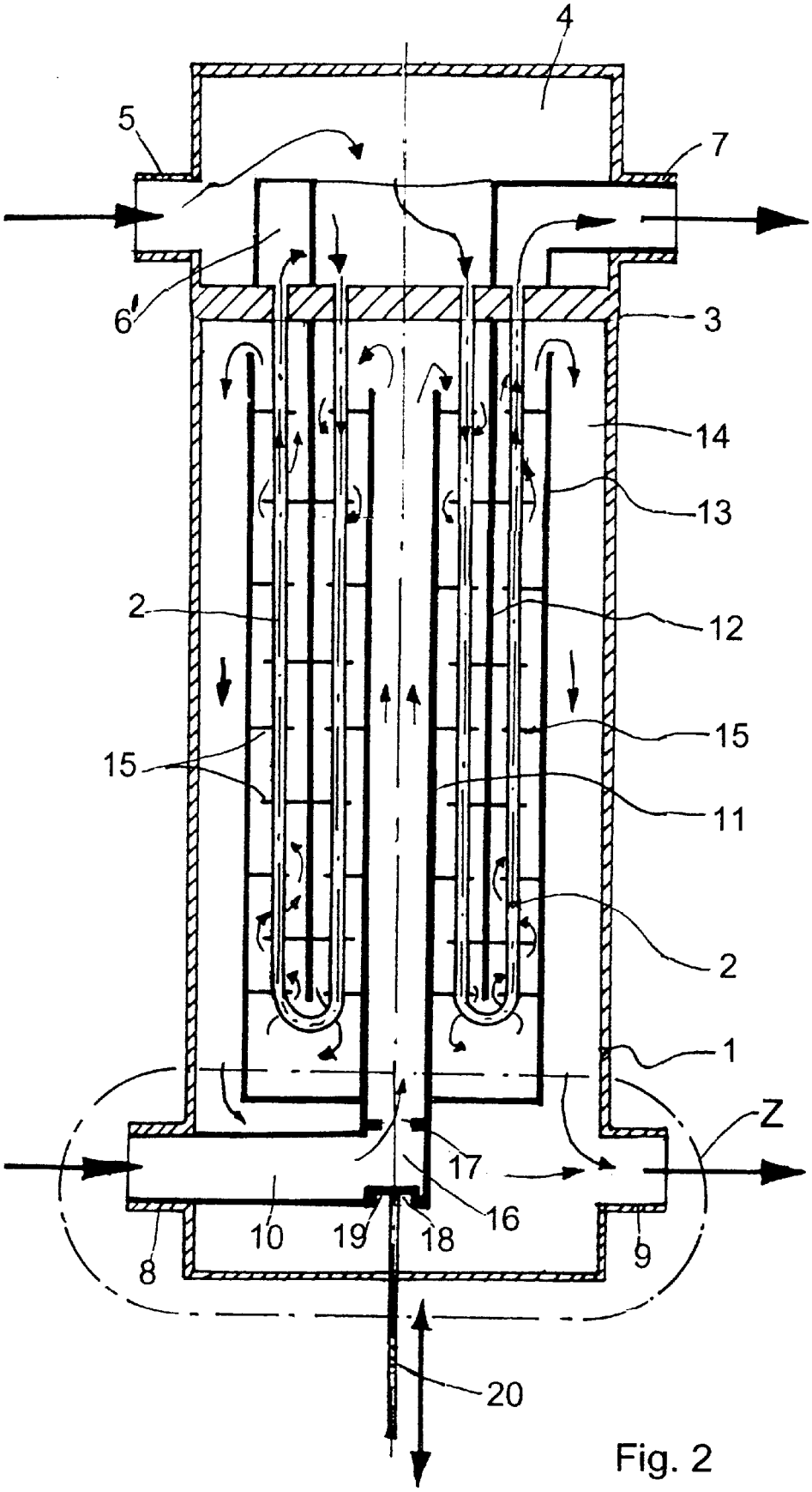
FIG. 2 is a longitudinal section through a heat exchanger according to another preferred embodiment.

In another preferred embodiment, as shown in FIG. 2, the flow direction of the first heat exchange medium in the pipes can also be opposite from that in the embodiment of FIG. 1. In that case, the exit chamber 6' is of annular cross-section and the entry chamber 4 unchanged so that the outflow ends of the pipes 2 which are located on the larger partial circle now open into the exit chamber 6'. On the side of the pipe supporting floor 3 which is oriented towards the pipes, the pressure jacket 1 is provided with a feed connection 8 for the supply of a second heat exchange medium, for example, a hot gas from an ammonia or methanol producing plant or from a coal degassing plant. On the same end of the heat exchanger, an outlet connection 9 is provided for removal of the second heat exchange medium.

The feed connection 8 is connected through a supply duct 10 with a central pipe 11 which is open at one end, extends along the longitudinal axis of the heat exchanger, and is surrounded by the U-shaped pipes 2. The open end of central pipe 11 is in the vicinity of the pipe-supporting floor 3. A cylindrical separating jacket 12 is positioned between the inner and outer legs of the U-shaped pipes. This separating jacket 12 is connected with the pipe-supporting floor 3 and extends downwardly to the return bends of the U-shaped pipes 2. A guide jacket 13 surrounds the external legs of the pipes 2 which jacket has an open and a closed end and is radially spaced apart from the pressure jacket 1, defining an intermediate annular space 14 therewith. The guide jacket 13 at its closed end is tightly connected with the central pipe 11 and has its open end close to the pipe-supporting floor 3. Metal deflector sheets or baffles 15 are positioned in the space enclosed by the central pipe 11 and the guide jacket 13 and perpendicular to the pipes 2.

The second heat exchange medium entering the heat exchanger through the feed connection 8 flows through the central pipe 11, is redirected in the vicinity of the pipe-supporting floor 3, subsequently flows through the intermediate space between the central pipe 11 and the separating jacket 12, is then redirected at the closed end of the guide jacket 13, flows thereafter through the intermediate space between the guide jacket 13 and the separating jacket 12, exits at the open end of the guide jacket 13 and enters into the annular space 14 between the guide jacket 13 and the pressure jacket 1, from where it is discharged by way of the outlet connection 9. The resulting flow of the second heat exchange medium flowing through the jacket is indicated by the arrows in FIG. 1. The medium in the jacket thereby flows in counter-current to the first heat exchange medium flowing through the pipes in the embodiment of FIG. 1 and in parallel thereto in the embodiment of FIG. 2. In the illustrated embodiments, the medium in the jacket is cooled by heat exchange with the cooler medium in the pipes 2 and reaches the pressure jacket 1 only in the cooled condition. In this way, additional protective insulation on the inside of the pressure jacket 1 is unnecessary. However, the heat exchanger of the present invention is not limited to this preferred mode of operation. It is also possible to direct the cooler heat exchanger medium through the jacket and the hotter heat exchange medium through the U-shaped pipes.

Figure 3:
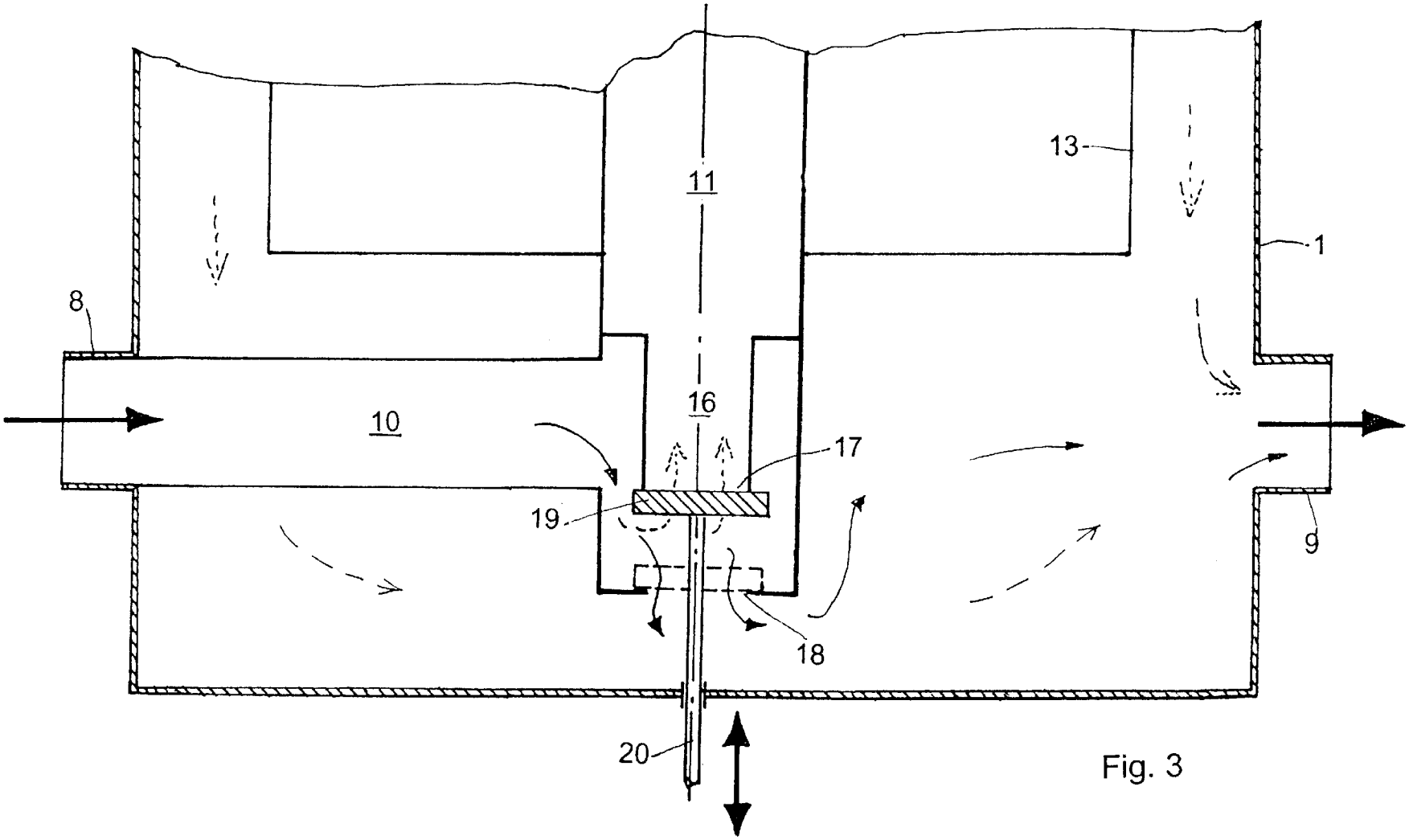
FIG. 3 is a detail view of the part Z of FIG. 1 or 2.

A cylindrical valve chamber 16 is integrated into the central pipe 11 at the inflow end thereof and the supply duct radially opens thereinto. The valve chamber 16 is provided with first and second openings 17, 18 respectively connected with the central pipe 11 and the interior of the pressure jacket 1. A valve plate 19 is axially movable in the valve chamber 16. This plate is movable between respective end positions by an operating rod 20 which protrudes from the pressure jacket 1. In one end position, the bypass position, the valve plate 19 closes the opening 17 to the central pipe 11 and in the other end position, the closed position, it closes the opening 18 to the interior of the pressure jacket 1. Therebetween any intermediate position is possible. In the bypass position (solid lines in FIG. 3) the heat exchange medium flowing into the valve chamber 16 through the entry connection 8 is removed directly and without cooling through second opening 18 and outlet connection 9 and without contact with the pipes 2. In the closed position (broken lines in FIG. 3) the medium flows into the central pipe 11 through first opening 17 and is guided along the pipes 2 with repeated redirectioning before removal thereof through the annular space 14 and the outlet connection 9. This case is also shown in FIGS. 1 and 2. In this way, the medium flow through the openings in the chamber 16 can be varied between zero and one hundred percent by way of a single adjustment movement of the rod 20 connected to the valve plate 19—i.e. through movement of a single adjustment member. Any desired exit temperature of the medium in the jacket or the pipes can be adjusted this way.

Changes and modifications in the specifically described embodiments can be carried out without departing from the scope of the invention which is intended to be limited only by the scope of the appended claims.

We claim:

1. A heat exchanger for transferring heat energy between first and second fluid heat exchange media, comprising:

an elongated outer pressure jacket provided with an entry connection at one end of the outer pressure jacket for the supply of the first heat exchanger medium and an exit connection at said one end for the removal of the first heat exchange medium;

U-shaped pipes positioned within the pressure jacket and affixed in a pipe-supporting floor that is connected with the pressure jacket at an opposite end of said outer pressure jacket;

a guide jacket surrounding the U-shaped pipes and radially spaced apart from an inside wall of the pressure jacket and defining an annular space therewith, inner and outer legs of the U-shaped pipes being respectively positioned on one of two concentric partial circles;

an inlet fitting on said pressure jacket communicating with the legs of said U-shaped pipes along one of said partial circles and an outlet fitting on said pressure jacket communicating with the legs of said U-shaped pipes along the other of said partial circles for passing said second heat exchange medium through said U-shaped pipes;

a central pipe extending along the longitudinal axis of the heat exchanger, connected with the entry connection, opening at an open end towards the interior of the heat exchanger, and extending from said one end of said outer pressure jacket to a location close to the pipe-supporting floor, the inner legs surrounding said central pipe;

a separating jacket between the inner and outer legs of the U-shaped pipes and connected to the pipe-supporting floor, the guide jacket being sealingly connected at one end thereof with the central pipe and having an open end lying close to the pipe-supporting floor;

a valve chamber formed on an input end of the central pipe remote from said open end thereof, said valve chamber being formed with opposite first and second openings, the first opening communicating between the central pipe and said entry connection, the second opening communicating between said entry communication and the interior of the pressure jacket; and a valve plate in the valve chamber and axially movable in the valve chamber to selectively close one of the openings.

2. The heat exchanger according to claim 1 wherein the pipe-supporting floor on a side remote from the pipes delimits an entry chamber in which an exit chamber is positioned, the entry chamber communicating with entry ends of the pipes, and the exit chamber being connected with the pipe-supporting floor and being provided with an exit connection, exit ends of all of the pipes opening into the exit chamber.

3. The heat exchanger according to claim 2 wherein the exit chamber is of circular cross-section and is centrally positioned within the entry chamber.

4. The heat exchanger according to claim 2 wherein the exit chamber is of annular cross-section.

* * * * *